US008022320B2

(12) United States Patent
Matsumoto et al.

(10) Patent No.: US 8,022,320 B2
(45) Date of Patent: Sep. 20, 2011

(54) LEVER ENGAGEMENT TYPE ELECTRIC POWER SOURCE CIRCUIT BREAKER

(75) Inventors: Mitsuhiro Matsumoto, Makinohara (JP); Shigeo Mori, Makinohara (JP); Takenori Ohmura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 438 days.

(21) Appl. No.: 12/250,631

(22) Filed: Oct. 14, 2008

(65) Prior Publication Data

US 2009/0159414 A1 Jun. 25, 2009

(30) Foreign Application Priority Data

Dec. 20, 2007 (JP) ..... 2007-328279

(51) Int. Cl.
*H01R 25/14* (2006.01)

(52) U.S. Cl. ..... 200/51 R; 439/157; 439/188

(58) Field of Classification Search ..... 200/335, 200/332, 559, 51 R; 439/157, 188
See application file for complete search history.

(56) References Cited

U.S. PATENT DOCUMENTS

| | | | | |
|---|---|---|---|---|
| 5,727,959 | A * | 3/1998 | Yagi et al. | 439/157 |
| 2003/0216072 | A1 * | 11/2003 | Kato et al. | 439/157 |
| 2005/0098419 | A1 * | 5/2005 | Matsui et al. | 200/311 |
| 2007/0134957 | A1 * | 6/2007 | Mori et al. | 439/157 |

FOREIGN PATENT DOCUMENTS

JP 2003100382 A 4/2003

* cited by examiner

*Primary Examiner* — Edwin A. Leon
(74) *Attorney, Agent, or Firm* — Sughrue Mion, PLLC

(57) ABSTRACT

This invention provides a lever engagement type electric power source circuit breaker in which a connector is not easily deformed and terminals and fuses accommodated inside are not exposed outside. The invention is lever engagement type electric power source circuit breaker includes a service plug including a service plug housing having a plurality of first connector terminals on a first side of the service plug housing, a metal cover covering a second side of the service plug housing opposing to the first side and including a main body, a boss integrally formed on the periphery of the main body, an electric power source side connector including a plurality of second connector terminals to be connected to the first connector terminals and a shaft, and a lever including a cam groove to be engaged with the boss and pivotably supported by the shaft. When the lever is operated to rotate, the service plug and the electric power source side connector are engaged with each other and then the first and the second connector terminals are electrically connected.

6 Claims, 16 Drawing Sheets

LEVER ENGAGEMENT TYPE ELECTRIC POWER SOURCE CIRCUIT BREAKER

BACKGROUND OF THE INVENTION

The present invention relates to a lever engagement type electric power source circuit breaker. Especially, the present invention relates to a lever engagement type electric power source circuit breaker suitably used for temporarily cutting off an electric current in a circuit at the time of inspection and maintenance of an electric vehicle or a hybrid vehicle having a high voltage circuit for driving a motor.

In an electric vehicle or a hybrid vehicle, a battery capacity is larger than that of a usual gasoline engine vehicle. Therefore, when a maintenance work is executed for an electric system of the vehicle, an electric power source circuit is opened by an electric circuit breaker so as to ensure the safety of the maintenance work. Therefore, a lever engagement type electric power source circuit breaker is conventionally known, by which an electric power source is cut off when a service plug attached to a terminal portion, which is connected to the electric power source circuit, is disconnected. Concerning this breaker, for example, refer to Patent Document JP-A-2003-100382.

In FIGS. 14 to 16, a lever engagement type electric power source circuit breaker 101A for an electric circuit of a high voltage and a high intensity of electric current is shown. The lever engagement type electric power source circuit beaker 101A includes a first connector housing 101 made of synthetic resin, a lever 102 made of synthetic resin attached to this one connector housing 101, a second connector housing 103 made of synthetic resin to which one connector housing 101 is attached when this lever 102 is operated.

As shown in FIG. 16, the first connector housing 101 includes a housing body 104 made of synthetic resin, and a cover 105 made of synthetic resin attached to the housing body 104 so that the cover 105 can close an upper portion of the housing body 104. On the housing body 104, a pair of protrusions 106 is provided. These protrusions have triangular pyramid shape. As the pair of protrusions are inserted into engagement holes 107 on the cover 105, the cover 105 is attached to the housing body 104. The conventional lever engagement type electric power source circuit breaker 101A has the cover 105 described above for a purpose of insulation so that fingers of an operator can not be easily contacted with terminals and fuses (not shown) incorporated into the connector housing 101.

A pair of first bosses 111 for guiding is protruded from an outer wall of the housing body 104. As shown in FIGS. 14 and 15, the pair of bosses 111 for guiding are respectively engaged with the guide grooves 120 of the lever 102. In a pair of arm plate 118*a*, 118*b* of the lever 102, the cam grooves 121 are symmetrically formed. When the first connector housing 101 is attached to the second connector housing 103, the bosses 136 used for a cam of the other connector housing 103 are inserted into the pair of cam grooves 121.

When the lever 102 is rotated about the first bosses 111 as shown in FIG. 15(*a*) under the condition that the second bosses 136 are inserted into the cam grooves 121, the connector housings 101 and 103 are engaged with each other at the rotation finishing position (shown in FIG. 15B) of the lever 102. In this way, terminals (not shown) of both the connectors are electrically engaged with each other. After the rotation of the lever 102 is finished, the lever 102 is moved straight under the guide of grooves 120 with respect to the first bosses 111 and the guide of the cam grooves 121 with respect to the second bosses 136. Then at the straight movement finishing position (shown in FIG. 15C), an engagement detection switch (not shown) is turned on and an electric power source circuit (not shown) is electrically connected.

In order to cut off the electric power source circuit, a reverse operation to the operation described above is executed. That is, when the lever 102 is moved straight from the state (shown in FIG. 15C)) in which the engagement detection switch is turned on, to the engagement detection switch is released. At the rotation finishing position (shown in FIG. 15B) of the lever 102, the engagement detection switch is turned off and the electric power source circuit is cut off.

BRIEF SUMMARY OF THE INVENTION

However, in the conventional lever engagement type electric power source circuit breaker, the following problems may be encountered. Since the cover 105 provided in the first connector housing 101 is made of resin, it tends to be deformed at the time of engaging the connectors. As a result, a fixing portion of the cover 105 is deformed and disconnected by the action of an external force. Therefore, there is a possibility that terminals and fuses accommodated in the first connector housing are exposed to outside of the first connector housing.

Since the second bosses 136 are provided in the second connector housing 103 made of resin, the mechanical strength of the second bosses may not be enough for operation of the lever 102. As a result there is a possibility at the lever 102 operation that the second connector housing 103 is damaged and the terminals and fuses are exposed from the inside.

The present invention has been accomplished to solve the above problems. An object of the present invention is to provide a lever engagement type electric power source circuit breaker in which a connector is not easily deformed and terminals and fuses accommodated inside are not exposed outside.

The above object can be accomplished by the following aspects of the invention.

A lever engagement type electric power source circuit breaker includes a service plug including a service plug housing having a plurality of first connector terminals on a first side of the service plug housing, a metal cover including a main body covering a second side of the service plug housing opposing to the first side and a boss integrally formed on the periphery of the main body, an electric power source side connector including a plurality of second connector terminals to be connected to the first connector terminals and a shaft, and a lever including a cam groove to be engaged with the boss and pivotably supported by the shaft. When the lever is operated to rotate, the service plug and the electric power source side connector are engaged with each other and then the first and the second connector terminals are electrically connected.

The second aspect of the invention according to the first aspect is that the cam groove guides the boss under the rotation of the lever.

The third aspect of the invention according to the first aspect is that the second side has an opening and the main body covers whole area of the opening.

The fourth aspect of the invention according to the first aspect is that the service plug housing has a recess portion to which the boss is fitted.

The fifth aspect of the invention according to the first aspect is that the service plug housing has a guide pin and the lever includes a guide groove in which the guide pin is engaged.

The sixth aspect of the invention according to the first aspect is that the cover includes a guide pin and the lever includes a guide groove in which the guide pin is engaged.

According to the first and the second aspects of the invention, the bosses for a cam are formed integrally with the cover made of metal. Therefore, the mechanical strength of the cover and the bosses for a cam is enough for the cover and the bosses not to be damaged at the time of rotating the lever. At the time of operation of rotating the lever, no pushing force concentrates on a portion of the connector housing. Therefore, the connector housing is not damaged. Accordingly, the terminals and fuses are not exposed from the inside of the connector housing. When the lever is operated, the cover is further pushed onto the housing side. Accordingly, there is no possibility that the cover is suddenly detached and the built-in terminals are exposed.

According to the third aspect of the invention, the main body covers all region of an opening of a portion on the opposite side to a portion engaged with the service plug. Accordingly, there is no possibility that the terminals and fuses provided inside the housings are exposed from the opening.

According to the fourth aspect of the invention, a recess portion for relieving the boss at the time of attaching the cover is formed in a housing of the service plug. Accordingly, when positions of the bosses are matched with the recess portions, the service plug and EPSS connector can be positively attached to each other.

According to the fifth aspect of the invention, a guide pin provided in the housing of the service plug is engaged with a guide groove provided in the lever and properly guides the lever. Accordingly, the lever can be accurately rotated and the service plug and the EPSS connector can be positively engaged and connected with each other.

According to the sixth aspect of the invention, a guide pin provided on the cover is engaged with a guide groove provided in the lever and properly guides the lever. Accordingly, the lever can be accurately rotated and the service plug and the EPSS connectors can be positively engaged and connected with each other.

According to the present invention, when the service plug is engaged with the EPSS connector when the lever is rotated, the service plug and the cover are neither deformed nor damaged. Therefore, no terminals and fuses are exposed from the service plug and it becomes possible to provide a lever engagement type electric power source circuit breaker of high durability and safety.

BRIEF DESCRIPTION OF THE DRAWINGS

FIG. 3A is a side view showing a state before the start of lever rotation, FIG. 3B is a side view showing a state of lever rotation and FIG. 3C is a side view showing a state after the completion of lever rotation.

DISCLOSURE OF PREFERRED EMBODIMENT

Referring to the accompanying drawings, an embodiment of the present invention will be explained below.

Figure 1:
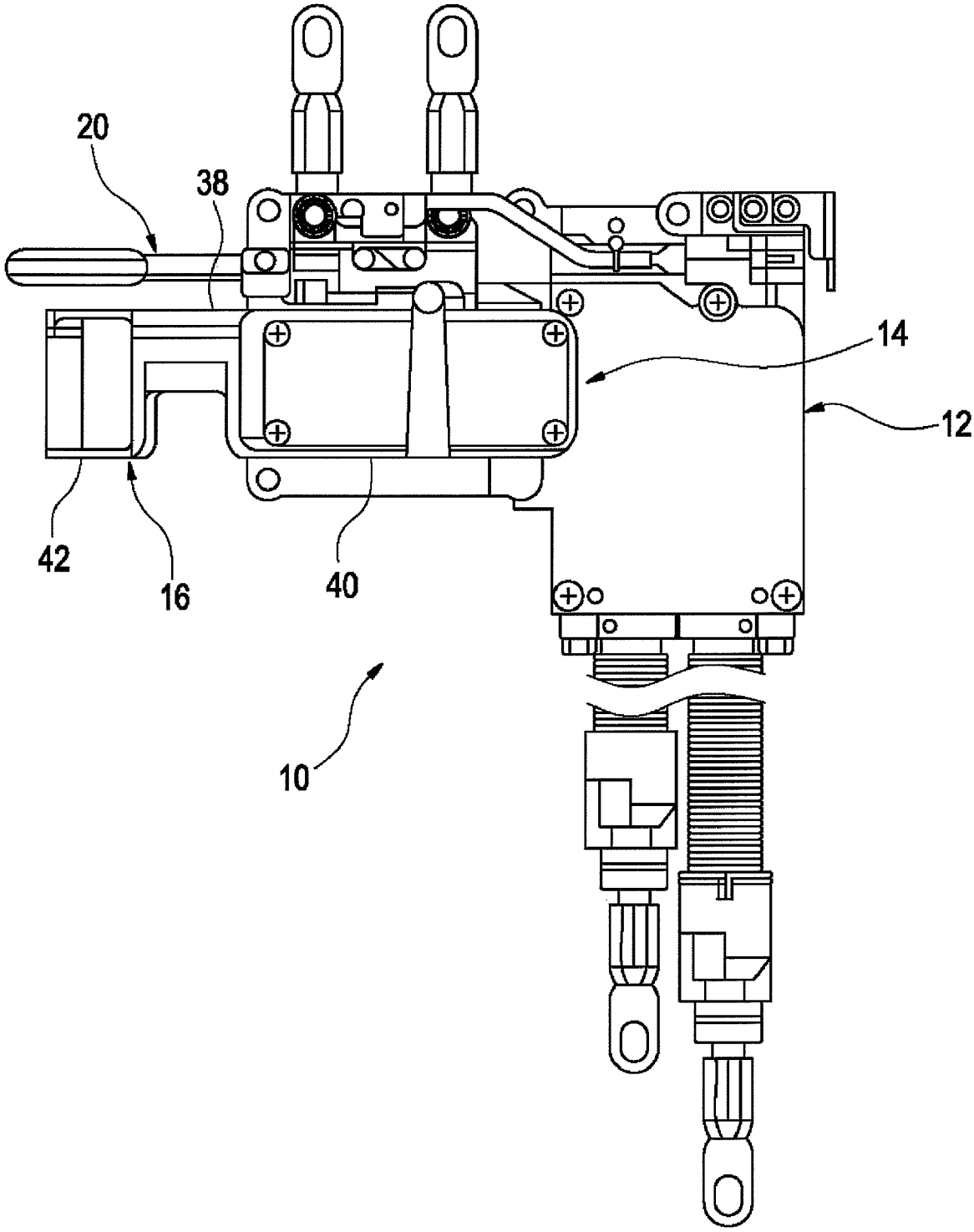
FIG. 1 is a plan view showing an electric power source circuit breaker of an embodiment of the present invention.
Figure 2:
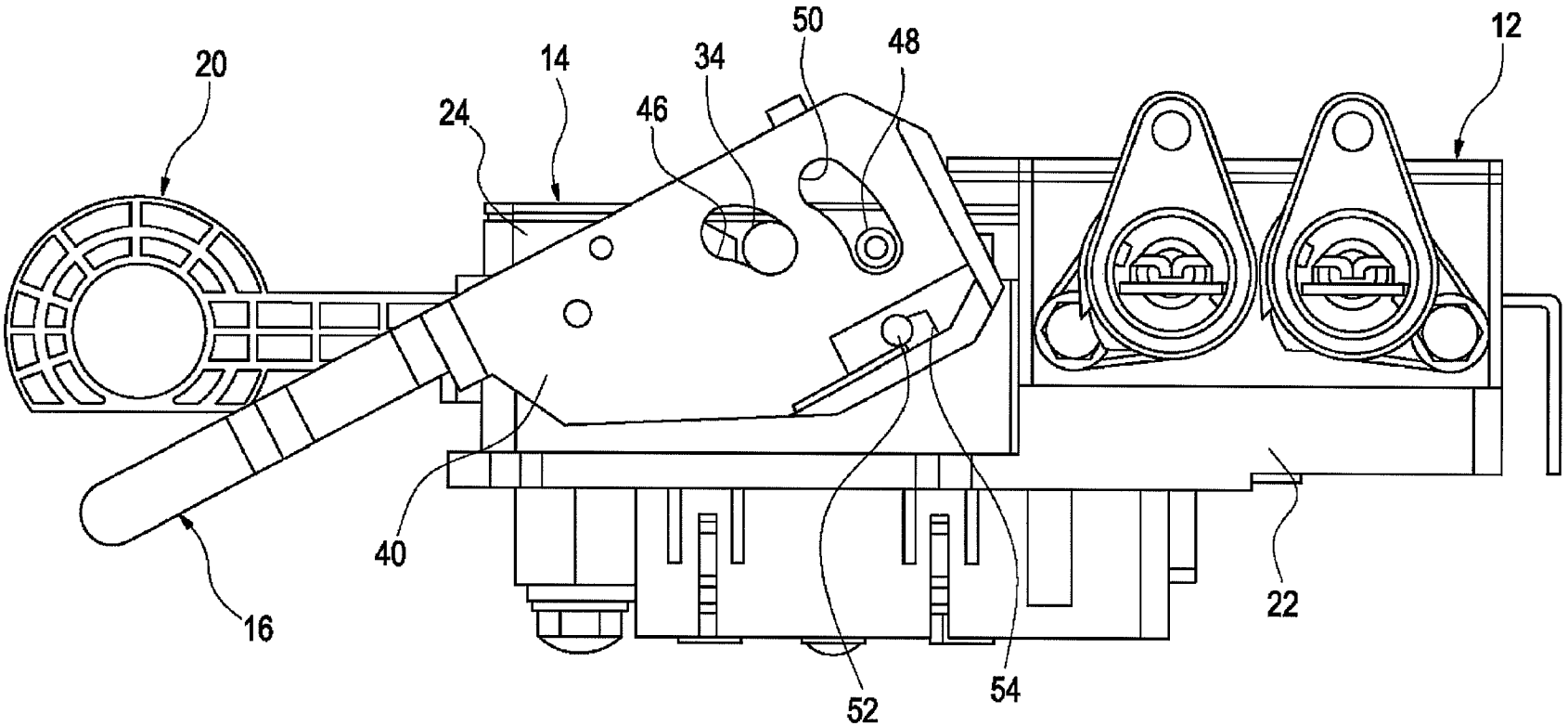
FIG. 2 is a side view showing an electric power source circuit breaker.
Figure 3A:
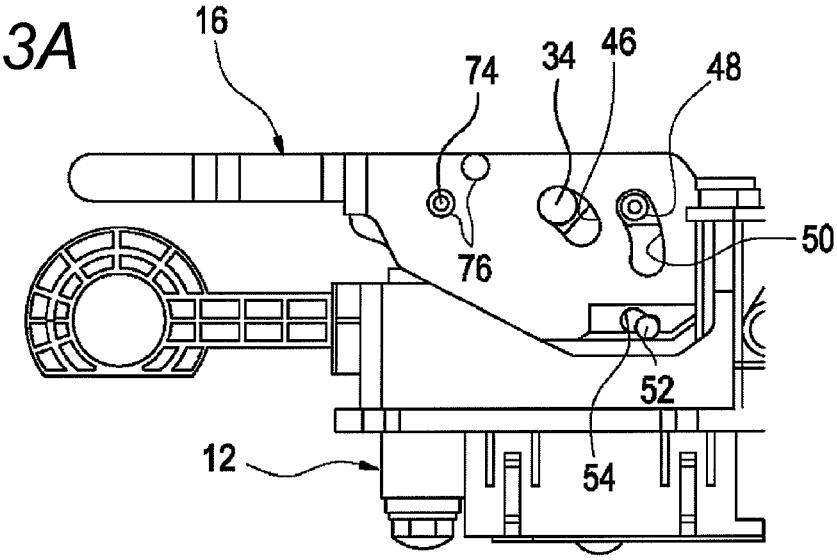
FIGS. 3A to 3C are views showing operation of an electric power source circuit breaker.
Figure 3B:
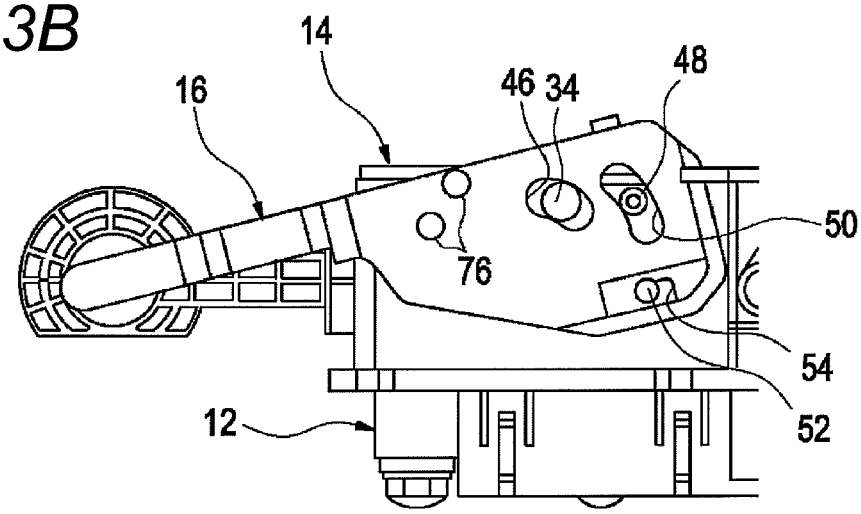
Figure 3C:
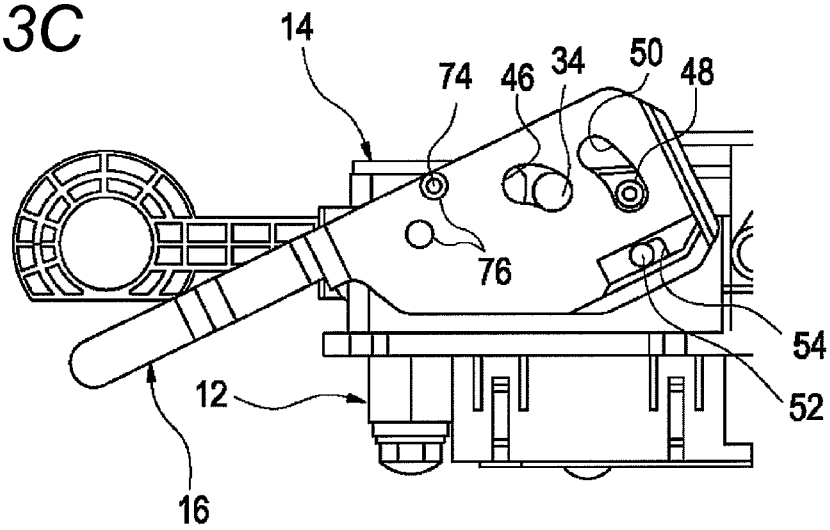
Figure 4:
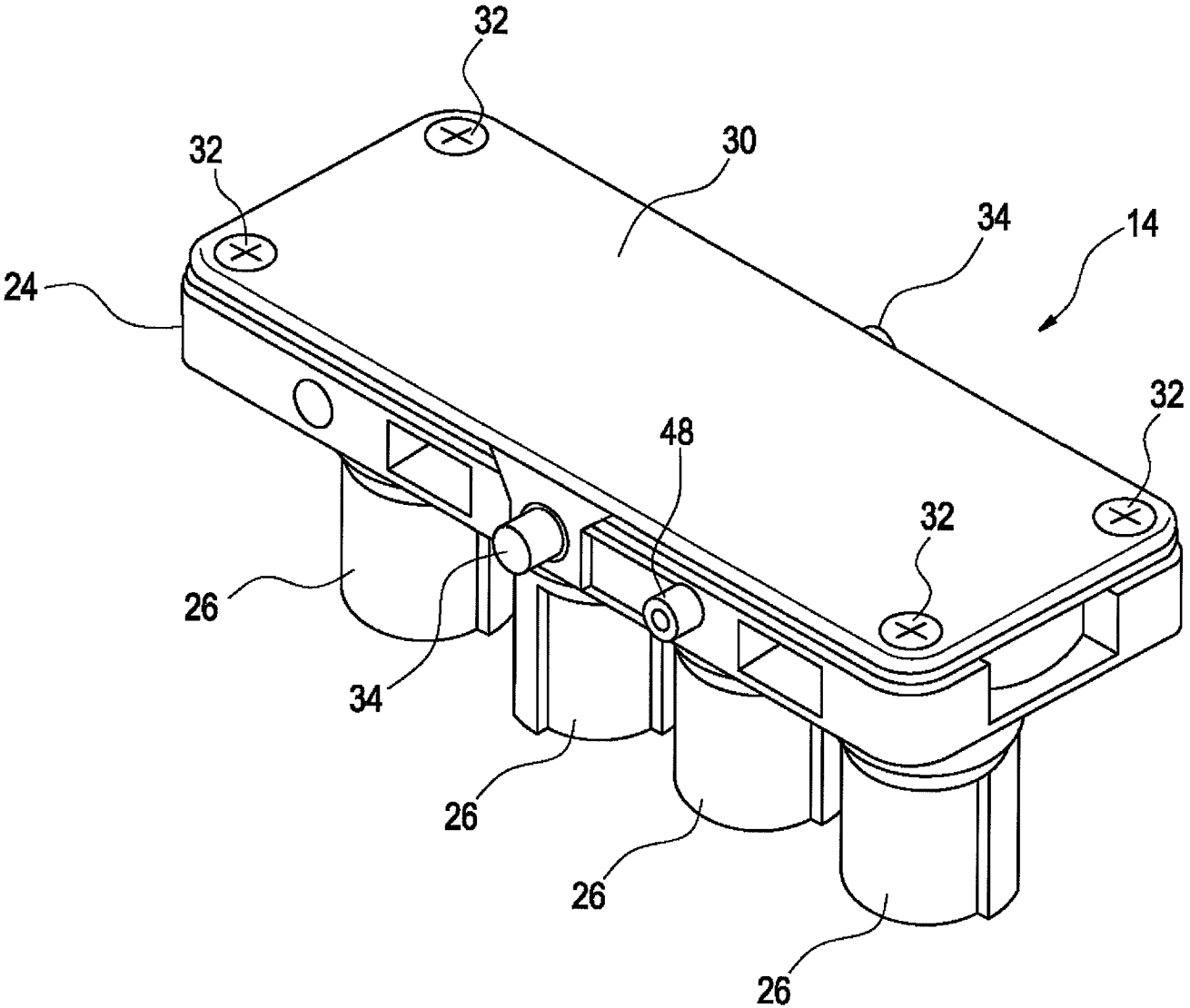
FIG. 4 is a perspective view showing an service plug.
Figure 5:
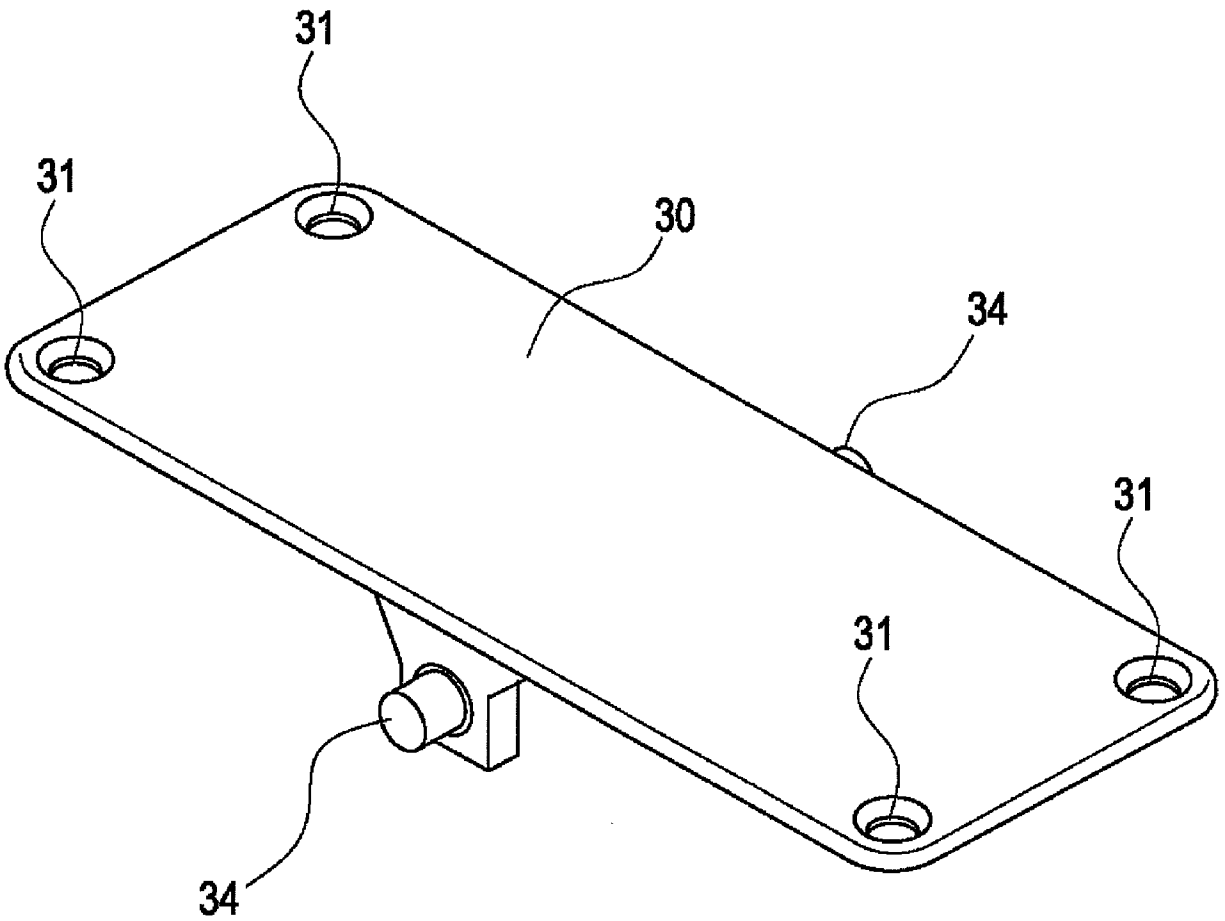
FIG. 5 is a perspective view showing a cover.
Figure 6:
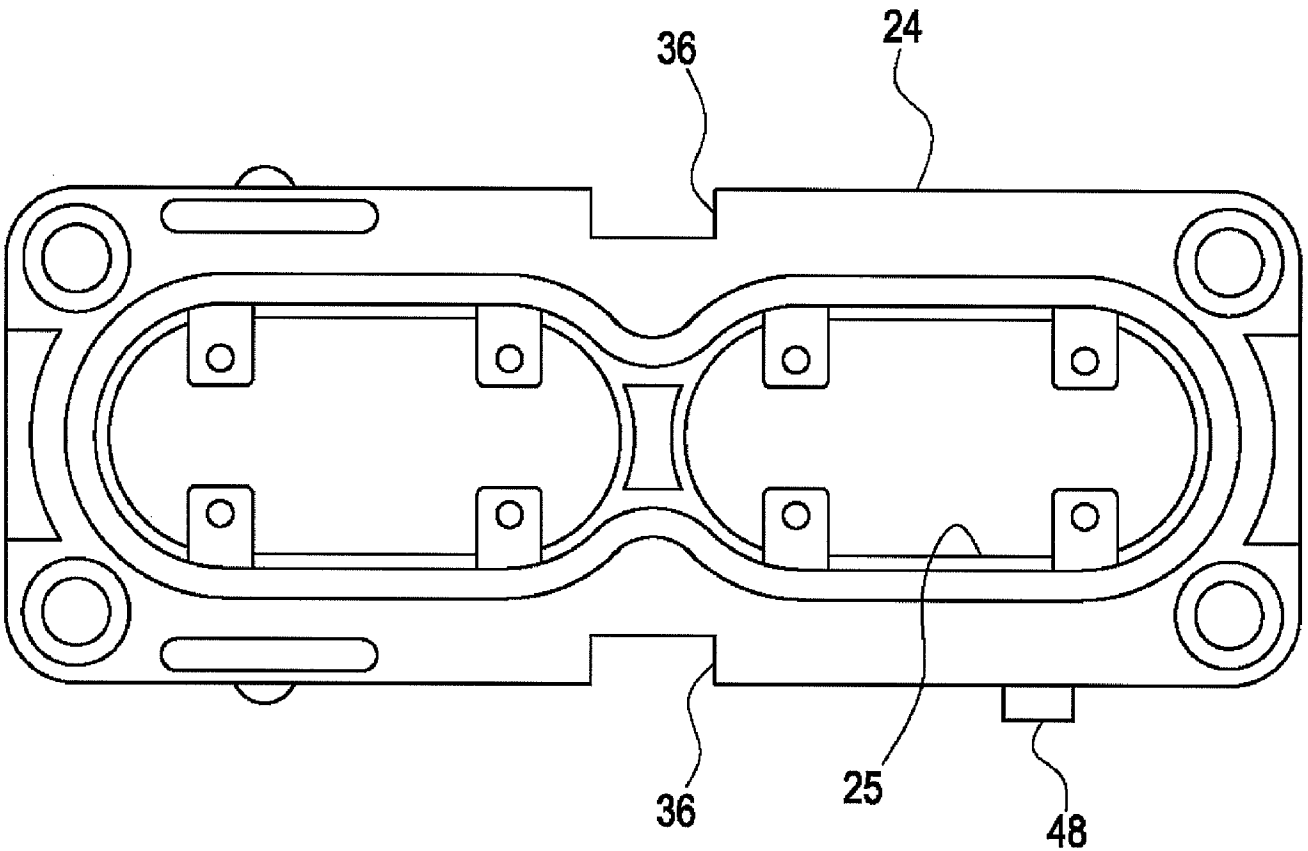
FIG. 6 is a plan view showing an service plug housing.
Figure 7:
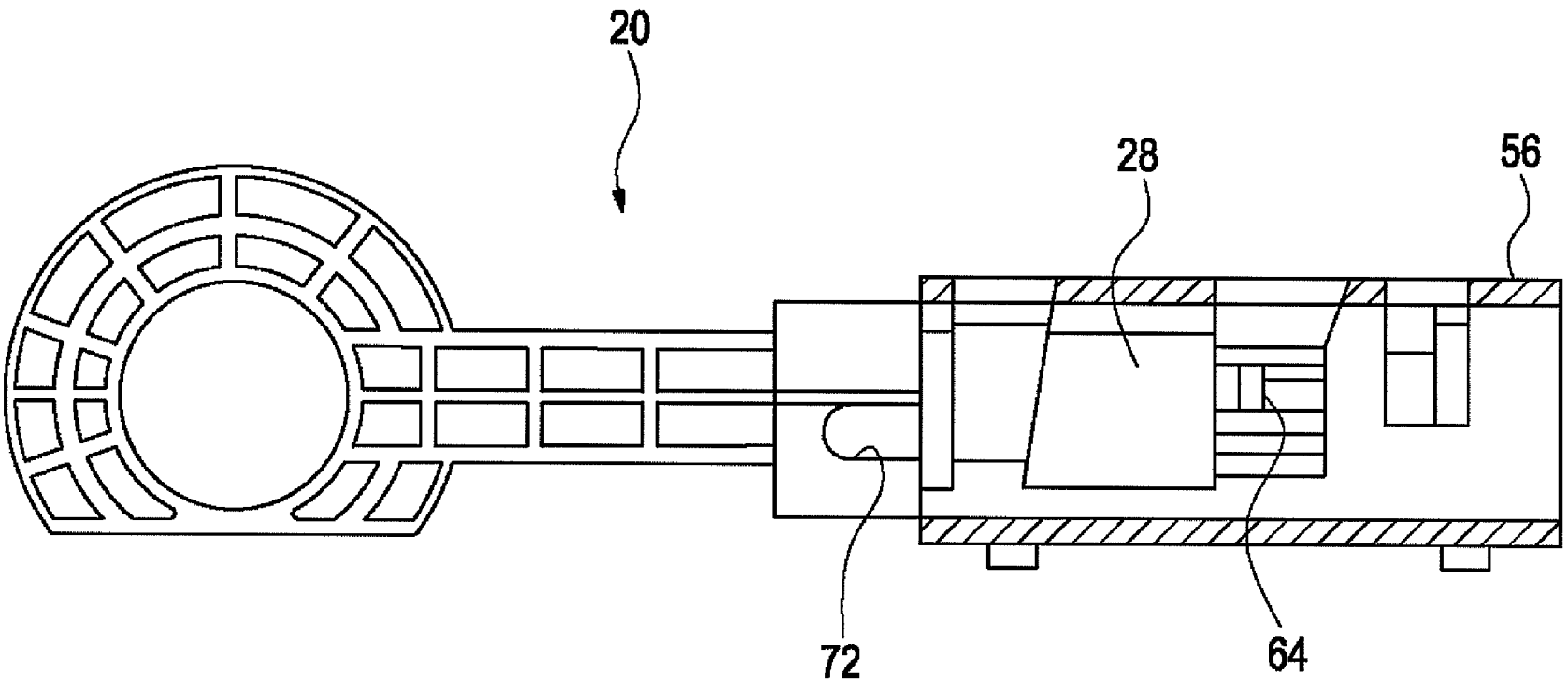
FIG. 7 is a side view showing an interlock handle.
Figure 8:
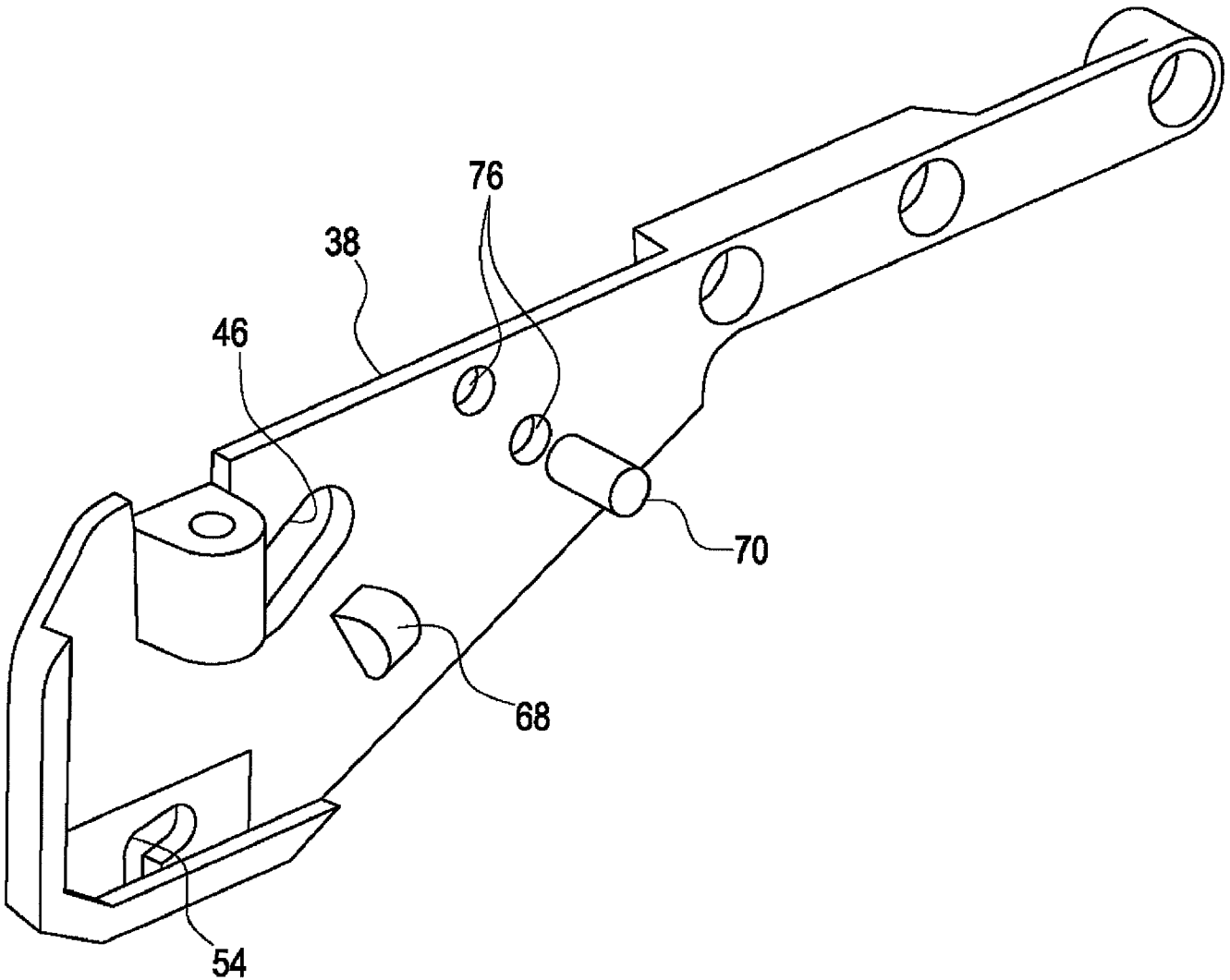
FIG. 8 is a perspective view showing one side plate of a lever for engagement.
Figure 9:
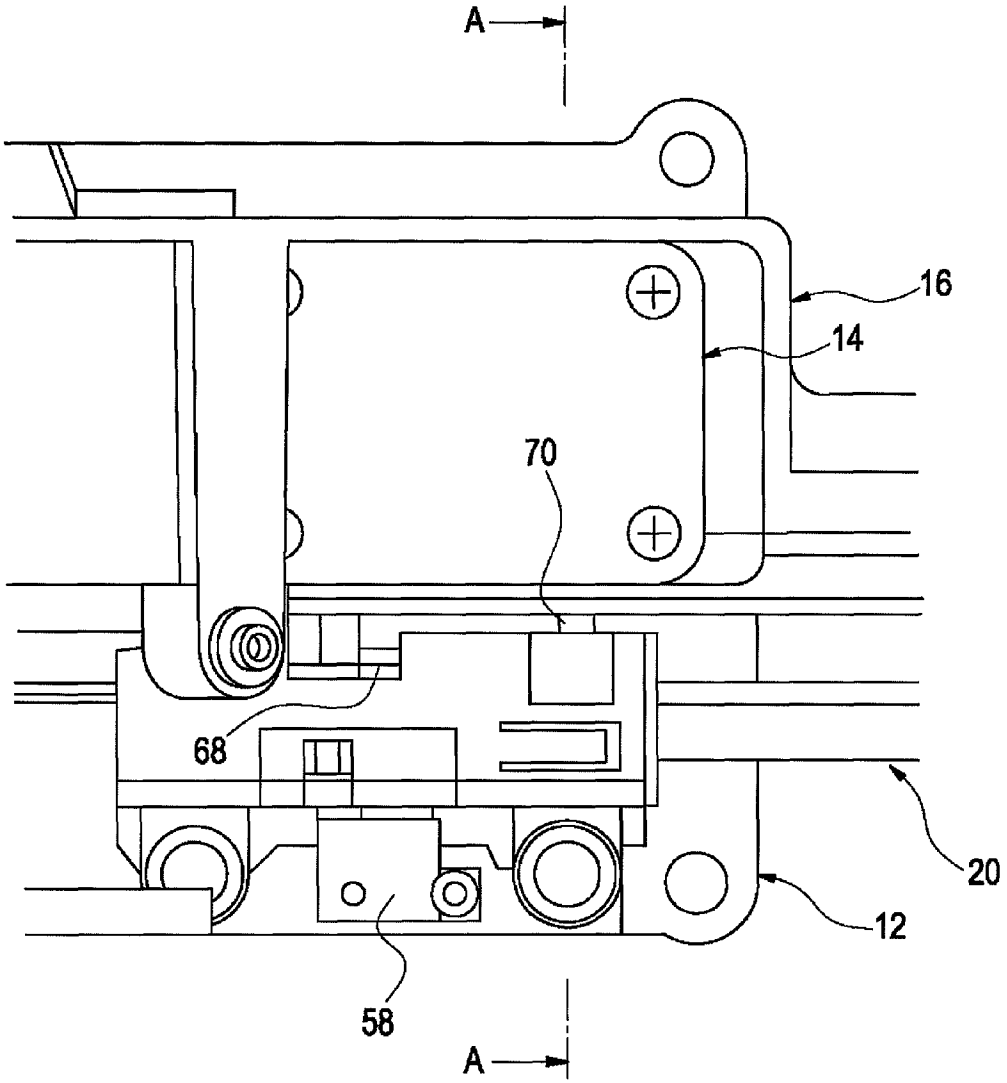
FIG. 9 is a plan view showing a primary portion of an electric power source breaker.
Figure 10:
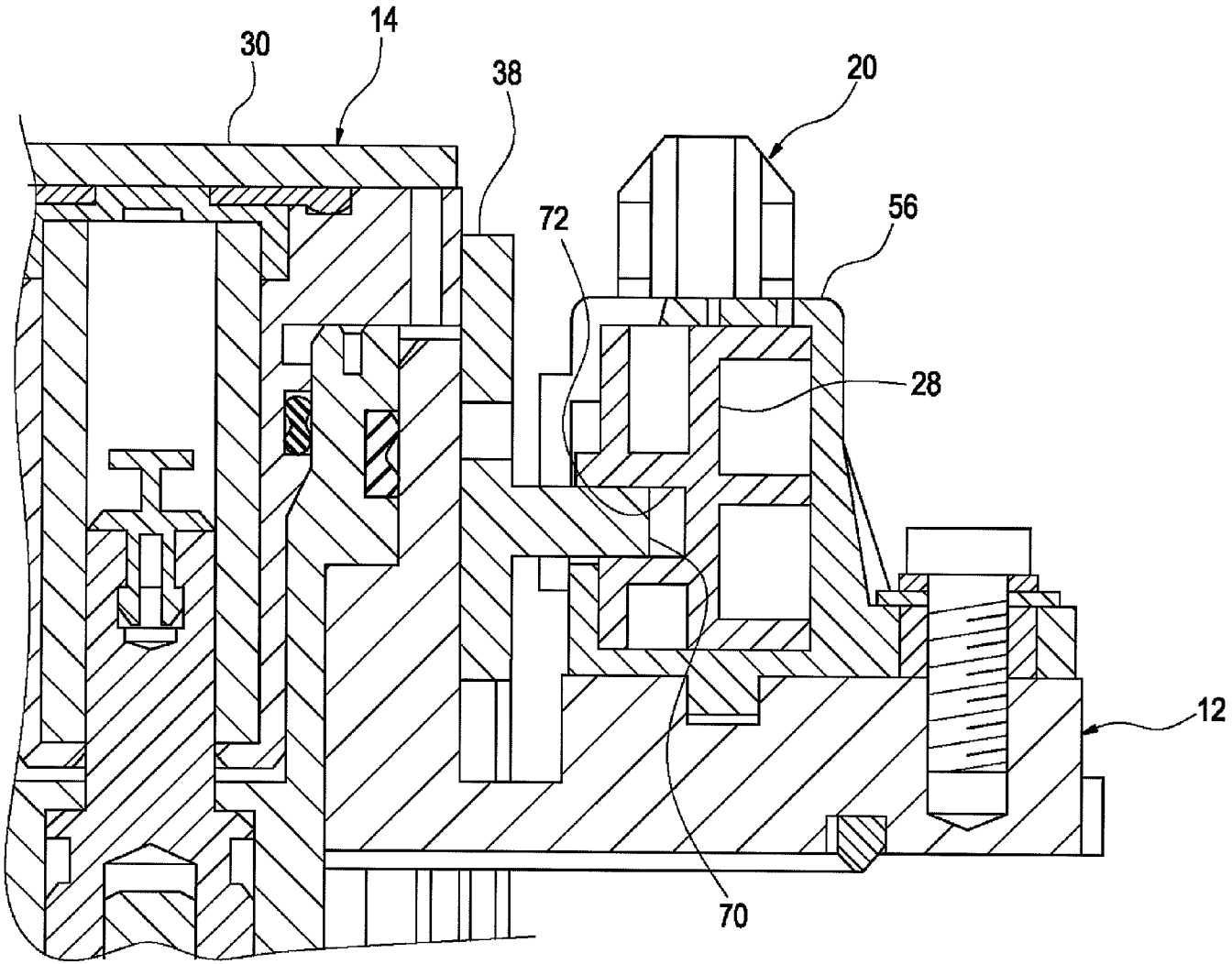
FIG. 10 is a sectional view taken on line A-A in FIG. 9.
Figure 11A:
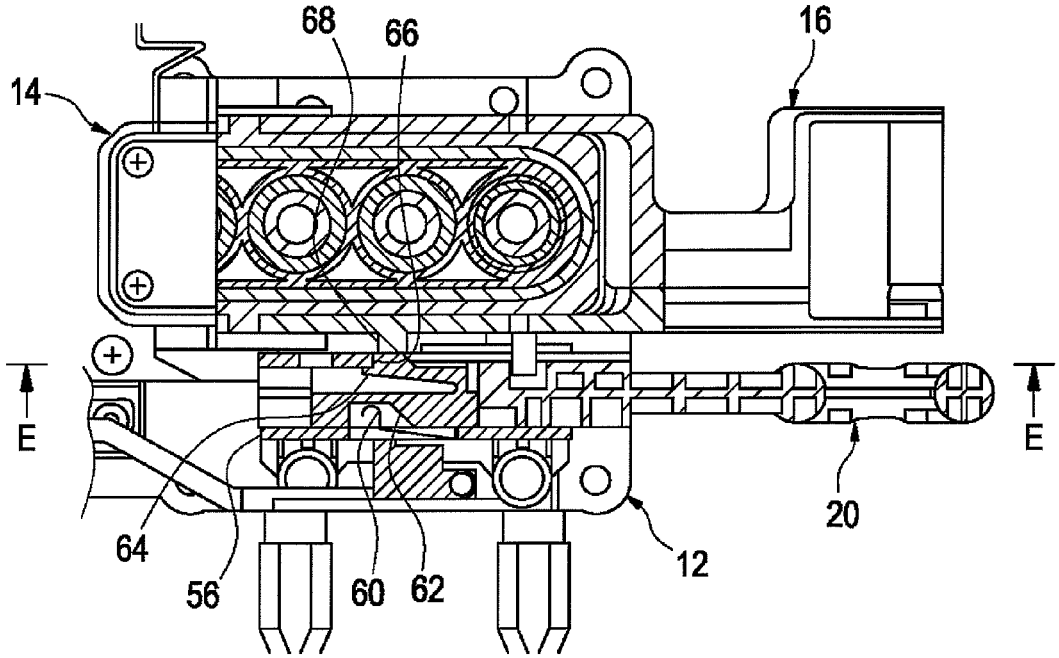
FIG. 11A is a laterally cross sectional view of a primary portion of an electric power source breaker.
Figure 11B:
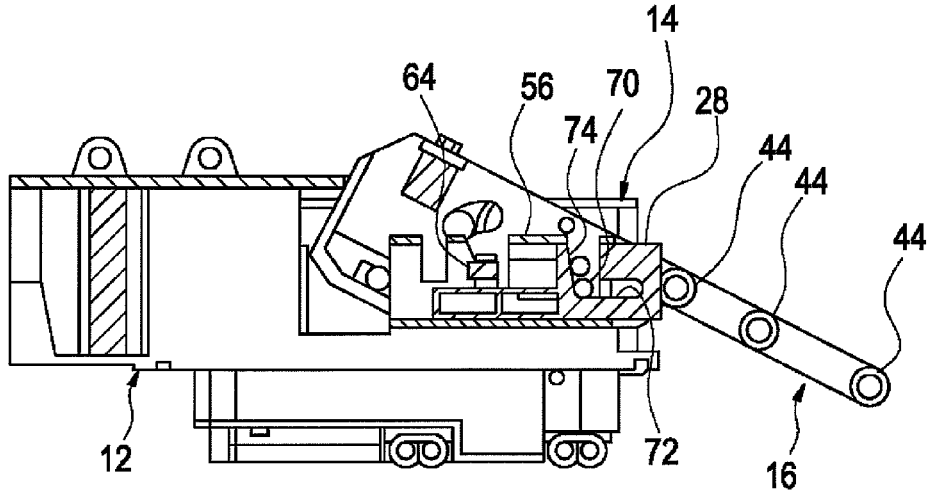
FIG. 11B is a sectional view taken on line E-E in FIG. 11A.
Figure 12A:
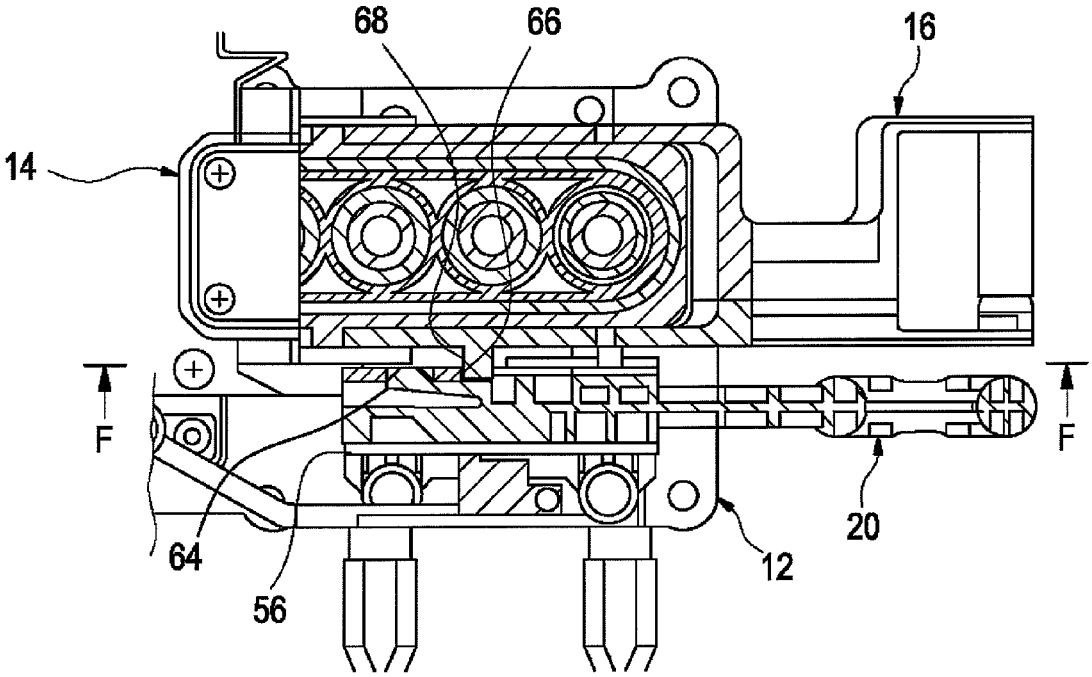
FIG. 12A is a laterally cross sectional view of a primary portion of an electric power source breaker.
Figure 12B:
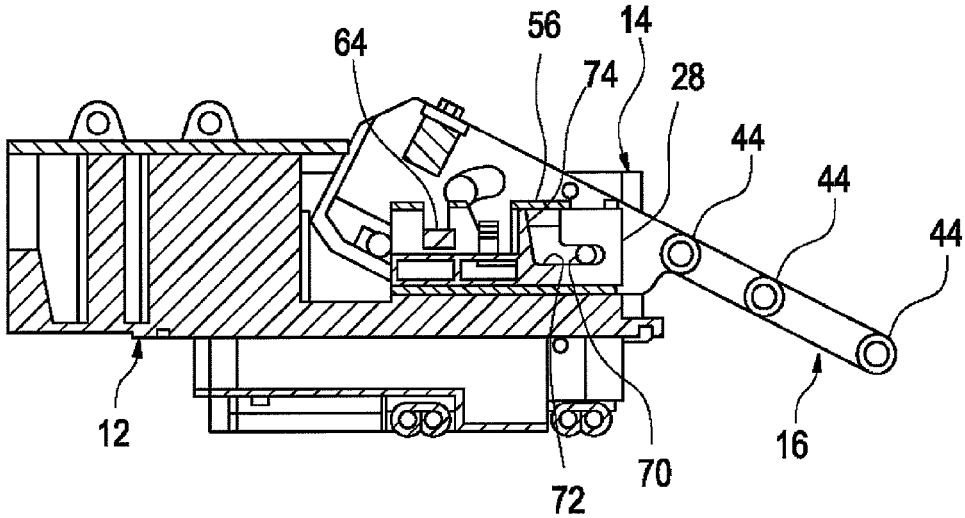
FIG. 12B is a sectional view taken on line F-F in FIG. 12A.
Figure 13:
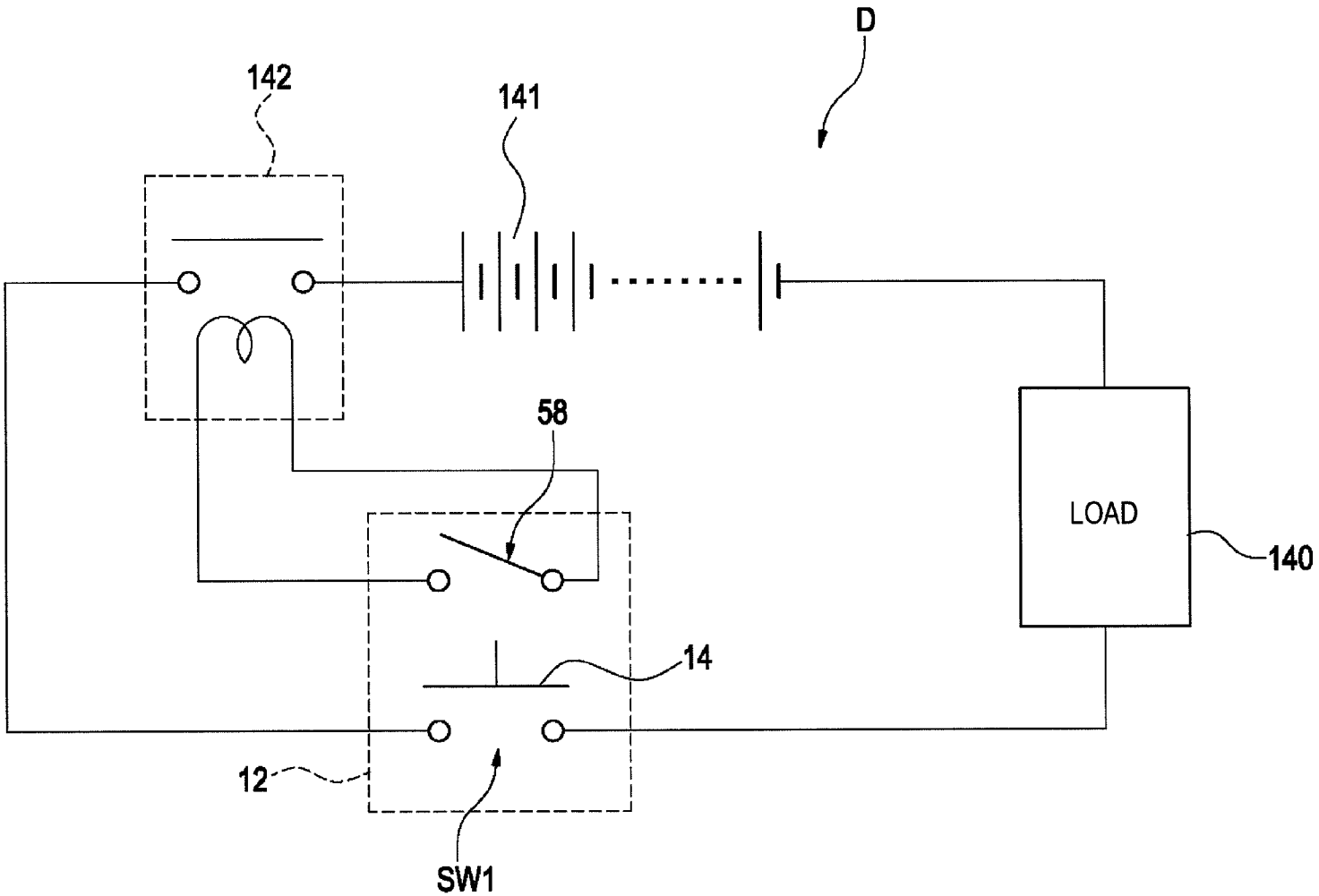
FIG. 13 is a circuit diagram of an electric power source circuit.
Figure 14:
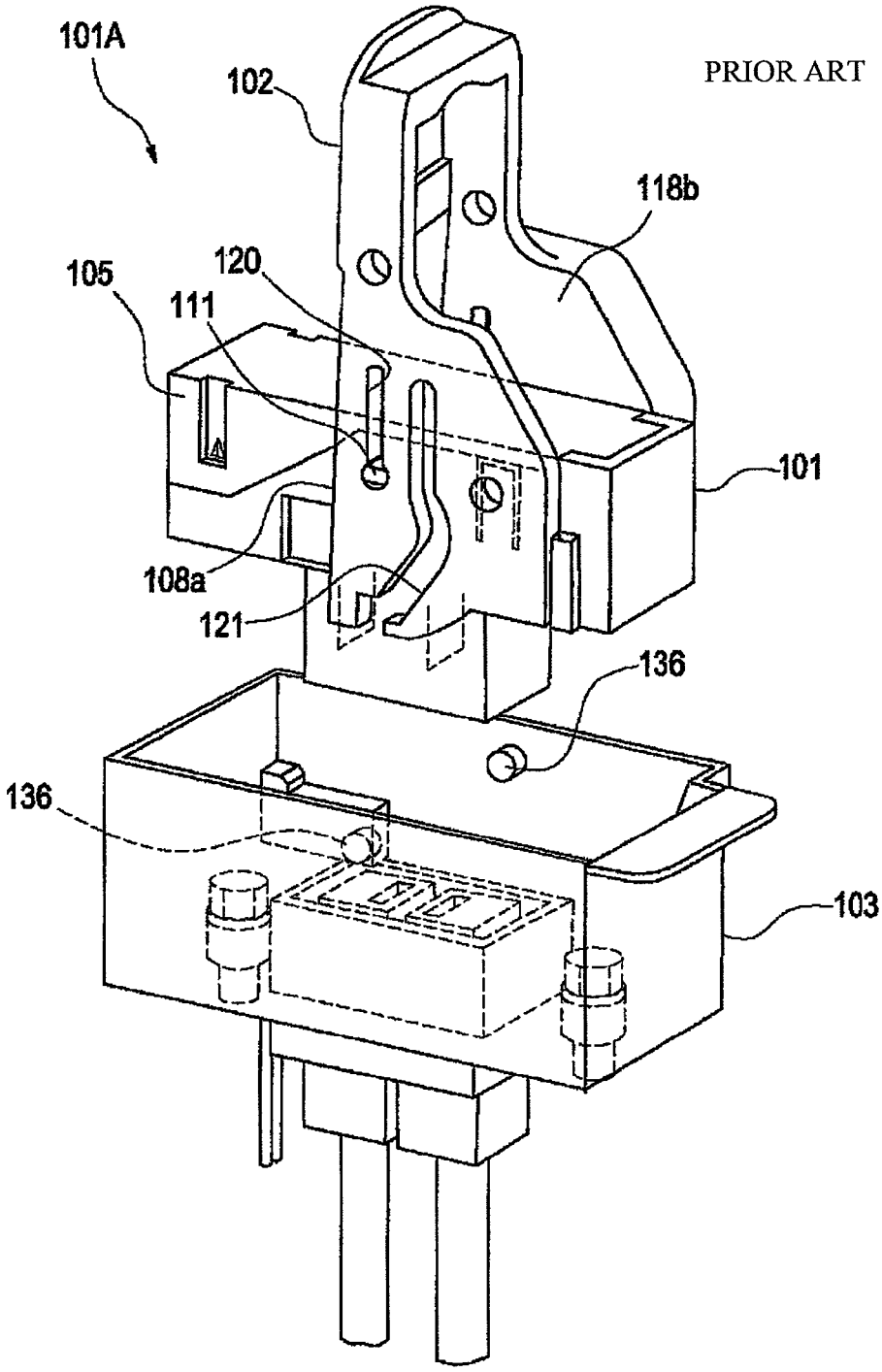
FIG. 14 PRIOR ART
FIG. 14 is an exploded perspective view showing a conventional electric power source circuit breaker.
Figure 15A:
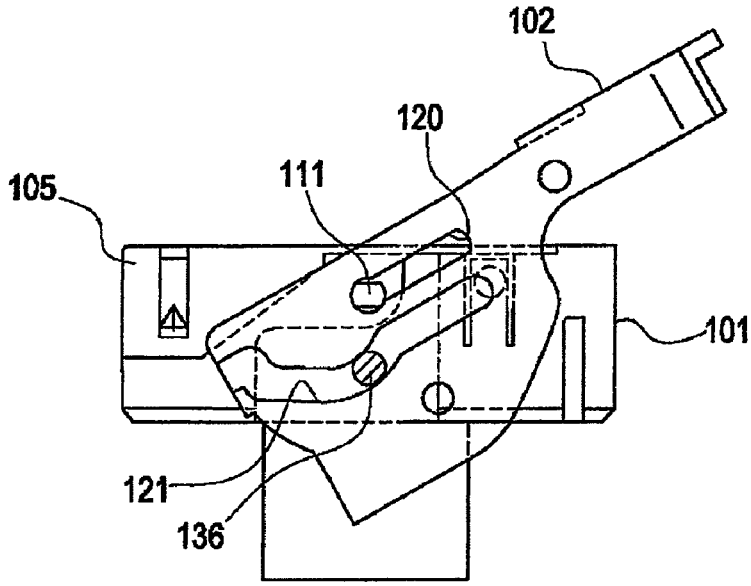
FIG. 15 A PRIOR ART
FIGS. 15A to 15C are views showing an action of a conventional electric power source circuit breaker.
Figure 15B:
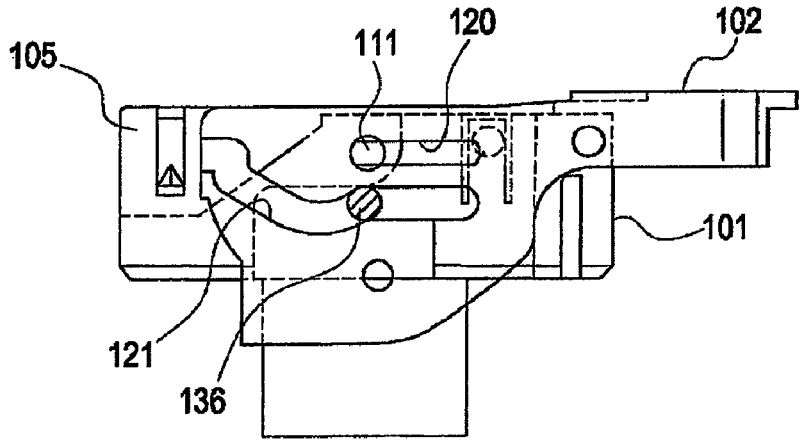
FIG. 15 B PRIOR ART
Figure 15C:
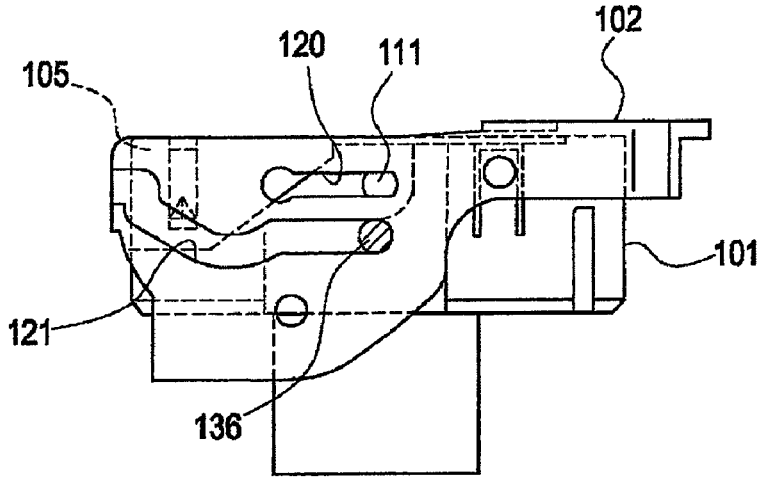
FIG. 15 C PRIOR ART
Figure 16:
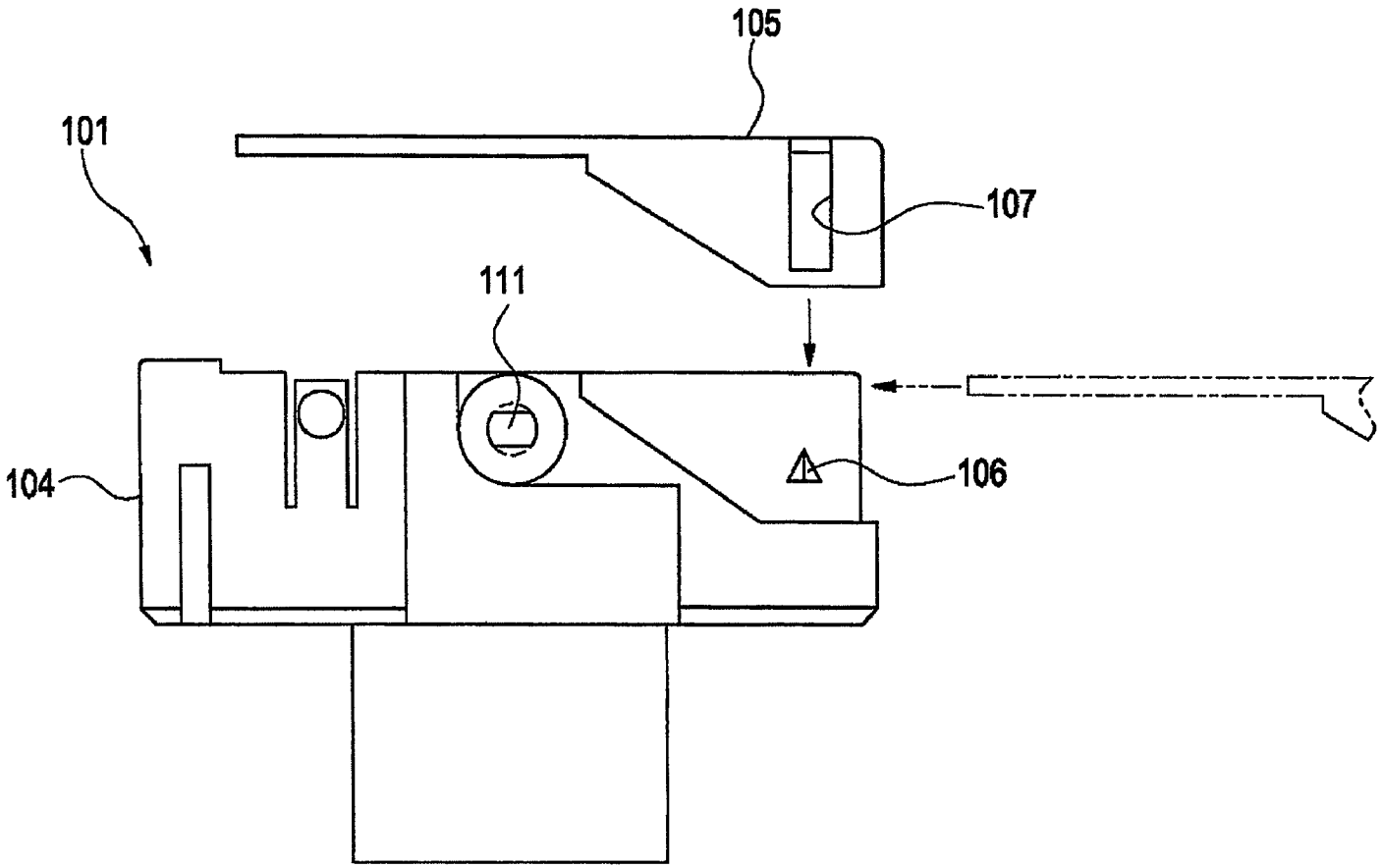
FIG. 16 PRIOR ART
FIG. 16 is a side view showing a service plug of a conventional electric power source circuit breaker.

FIG. 1 is a plane view showing an electric power source circuit breaker of an embodiment of the present invention. FIG. 2 is a side view showing an electric power source circuit breaker. FIG. 3A to FIG. 3C is a view showing operation of an electric power source circuit breaker. FIG. 3A is a side view showing a state before the start of lever rotation. FIG. 3B is a side view showing a state of lever rotation. FIG. 3C is a side view showing a state after the completion of lever rotation. FIG. 4 is a perspective view showing an service plug. FIG. 5 is a perspective view showing a cover. FIG. 6 is a plan view showing an service plug housing. FIG. 7 is a side view showing an interlock handle. FIG. 8 is a perspective view showing one side plate of a lever for engagement. FIG. 9 is a plane view showing a primary portion of an electric power source breaker. FIG. 10 is a sectional view taken on line A-A in FIG. 9. FIG. 11A is a laterally cross sectional view of a primary portion of an electric power source breaker. FIG. 11B is a sectional view taken on line E-E in FIG. 11A. FIG. 12A is a laterally cross sectional view of a primary portion of an electric power source breaker. FIG. 12B is a sectional view taken on line F-F in FIG. 12A. FIG. 13 is a circuit diagram of an electric power source circuit.

The electric power source circuit breaker 10 includes an electric power source side connector (EPSS connector) 12, a service plug 14, a lever 16, and inter lock handle 20. The EPSS connector 12 has a plurality of connection terminals containing source connection terminals (not shown). There source connection terminals are electrically connected to an electric power source through electric wires. The service plug 14 is to be engaged with the EPSS connector 12 by the lever operation. The service plug 14 has connector terminals which are electrically connected to the connection terminals at the time of engagement with the EPSS connector 12. The lever 16 executes engagement and disengagement operation between the EPSS connector 12 and the service plug 14. The lever 16 is made of metal. The inter lock handle 20 has an inter lock switch 28. The service plug 14 is disengaged from the EPSS connector 12 when it is necessary to cut off the electric power source circuit.

The EPSS connector housing 22 of the EPSS connector 12 is made of metal and formed into a box-shape. The plurality of connection terminals arranged in the EPSS connector housing 22 includes at least one source connection terminal for an electric power source electrically connected to the electric power source and at least one connection terminal for electric parts electrically connected to an electric part.

The service plug housing 24 is made of synthetic resin. The service plug housing 24 has four hoods 26. As shown in FIG. 4, the foods 26 are open being opposed to the EPSS connector 12. In each hood 26, the connector terminals are provided which are connected to the source connection terminal and the parts connection terminal in the EPSS connector housing 22. These connection terminals are electrically connected by U-shaped terminal provided in the service plug housing 24.

As shown in FIG. 7, the interlock switch 28 for detecting a completion of the engagement of the EPSS connector housing 12 with the service plug housing 24 is provided in the interlock handle 20 and operated by the interlock handle 20. The interlock handle 20 is slidably attached to an upper portion of the EPSS connector housing 22. When the interlock handle 20 is pushed into the most inner portion, the interlock switch 28 is turned on. At positions except for the most inner portion, the interlock switch 28 is turned off. In the state in which the interlock switch 28 is turned on, the micro-switch 58 described later is turned on. In the state in which the interlock switch 28 is turned off, the micro-switch 58 described later is turned off.

As shown in FIG. 13, the electric power source circuit D includes a load 140, an electric power source 141 for supplying electric power to the load 140. And also, a power switch SW1 and a relay circuit 142 are electrically connected in series to the load 140 and the electric power source 141. The power switch SW1 is formed by the EPSS connector 12 and the service plug 14. The micro-switch 58 operated by the interlock switch 28 is electrically connected to the relay circuit 142. When the service plug 14 and the EPSS connector 12 are electrically connected to each other and the micro-switch 58 is turned on, the relay 142 is turned on and electric power is supplied from the electric power source 141 to the load 140. When the micro-switch 58 is turned off, the relay 142 is turned off. Therefore, the electric power source circuit is turned off.

In an upper portion of the service plug housing 24, that is, in a portion opposing to the portion where the service plug housing 24 is engaged with the EPSS connector 12 (that is, in a portion on the opposite side to the hood 26), the cover 30 made of metal shown in FIG. 5 is attached. By the cover 30 concerned, all region of the opening 25 (shown in FIG. 6) in the upper portion of the service plug housing 24 is covered. Accordingly, in a state in which the cover 30 is detached, terminals are exposed from the inside of the service plug housing 24 through the opening 25.

As shown in FIGS. 4 and 5, the cover 30 has four holes 31. The cover 30 is fixed to the service plug housing 24 by the machine screw 32 respectively inserted into the holes 31. On both sides of the cover 30 in the width direction, a pair of first bosses 34 for a cam is integrally provided. The first bosses 34 are used for transmitting torque of the lever 16 to the service plug 14. Examples of metal for the cover 30, on which the first bosses 34 for a cam are integrally formed, are aluminum and stainless steel which are not easily deformed.

As shown in FIG. 6, the service plug housing 24 has recess portions 36. When the cover 30 is attached, the first bosses 34 passes through the recess portion 36. Since the recess portions 36 are provided, the cover 30 can be easily positioned and it is possible to mount the cover 30 on the service plug housing 24 at an accurate position. In this connection, in the present embodiment, the first bosses 34 are provided at the center in the longitudinal direction of the cover 30. Therefore, the recess portions 36 of the service plug housing 24 are also provided at the center in the longitudinal direction. However, in the case where the first bosses 34 are provided at biased positions, the recess portions 36 are also formed at biased positions corresponding to the first bosses 34. Therefore, at the time of attaching the cover 30 to the service plug housing 24, it is easy to confirm whether the cover 30 is arranged for a correct direction.

The lever 16 is made of metal and includes a first side plate 38 and a second side plate 40 engaged with both side plates of the service plug housing 24, and an operating portion 42 connecting the first and second side plates 38, 40. The operating portion 42 is operated by fingers. As shown in FIG. 8, the first side plate 38 is formed out of only itself. The second side plate 40 is formed being integrated with the operation portion 42. The lever 16 is composed in such a manner that the first and second side plates 38, 40 are fixed to each other by the machine screws 44.

On the first and second side plate 38, 40 of the lever 16, a cam groove 46 is formed which is engaged with the first boss 34 for a cam provided on the cover 30 so that the first boss 34 can be guided. On the other side plate 40 (see FIG. 2), a guide groove 50 is formed which is engaged with the guide pin 48 provided in the service plug housing 22 so that the guide pin 48 can be guided. In a lower portion of the first and second side plates 38, 40 of the lever 16, a cutout portion 54 is formed. The cut out portion 54 is engaged with the second boss 52 for a fulcrum of rotation provided in the EPSS connector 12. The cutout portion 54 is formed into a bent groove shape so that the second boss 52 for a fulcrum of rotation can not be pulled out when the lever 16 is rotated a little with respect to the second boss 52 for a fulcrum of rotation.

The lever 16 is attached to the service plug housing 24 when the first boss 34 and the guide pin 48 are respectively engaged with the cam groove 46 and the guide groove 50 formed on the side plates 38, 40. Then the cutout portion 54 of the first and second side plates 38, 40 is engaged with the boss 52 for a fulcrum of rotation of the EPSS connector housing 12. At this time, by pushing the lever 16 with the fulcrum of the 2nd boss 52, the lever 16 rotates. Therefore, and inner periphery of the cam groove 46 pushes the first bosses 34 in the direction of engagement. Then the service plug housing 24 comes to close to the EPSS connector housing 22. In this way, the engagement operation is executed.

As described above, the EPSS connector 12 is attached with the interlock handle 20 having the interlock switch 28 which connects the electric power source circuit only when the EPSS connector 12 and the service plug 14 are perfectly connected to each other. The interlock handle 20 is slidably attached to the guide member 56. The guide member 56 is formed into a hollow square pipe shape and provided in the EPSS connector 12. On an opposite end side of the interlock handle 20 to the operating portion 42, the interlock switch 28 is provided. The interlock switch 28 opens and closes the micro-switch 58 provided in the EPSS connector 12. At the position shown in FIG. 11 where the interlock handle 20 is drawn out, the micro-switch 58 is turned off. At the position shown in FIG. 12 where the interlock handle 20 is pushed into the most inner portion, the switch terminal 60 shown in FIG. 11 is pushed by the oblique face 62 of the interlock switch 28 and contacted with an opponent's side switch terminal (not shown) and the micro-switch 58 is turned on. In this connection, the micro-switch 58 has a water-proof structure.

As shown in FIGS. 11A, 11B, 12A, and 12B, a lance 64 is provided on a lever 16 hand side of the inter lock switch 28. On a side of the guide member 56 corresponding to the lance 64, a lance engagement hole 66 for engaging the lance 64 is formed. As shown in FIG. 8, on the first side plate 38 on the interlock switch side of the lever 16, a lock release member 68 formed out of a protrusion. The lock release member 68 releases an engagement of the lance 64 when it enters the lance engagement hole 66 by the rotation of the lever 16, is provided.

As shown in FIG. 8, on the side first plate 38 of the lever 16, a lock pin 70 for preventing rotation is provided. On the side opposing to the interlock handle 20, a lock groove 72 is formed in the sliding direction. The lock pin 70 is inserted into the lock groove 72. In this connection, an upward cutout 74 for introducing the lock pin 70 is formed. This upward cutout 74 continues to an end portion on the interlock switch forward end side of the lock groove 72. When the lever 16 is rotated to a rotation end position, the lock pin 70 of the lever 16 enters the lock groove 72 from the cutout 74 of the interlock handle 20. Successively, when the interlock handle 20 is slid and pushed in, the lock pin 70 of the lever 16 proceeds into an inner portion of the lock groove 72 of the interlock handle 20. Therefore, the lever 16 is locked so that it can not be rotated. In this case, when a dimensional relation between the lock pin 70 and the lock groove 72 is set so that there is no space to be formed between them, the lock pin 70 is closely engaged with the lock groove 72. Therefore, rattle caused by the vibration of a vehicle can be prevented.

An engagement operation of the service plug 14 will be explained below.

In order to engage and connect the service plug 14 with the EPSS connector 12, as shown in FIG. 3A, the cutout 54 of the lever 16 attached to the service plug 14 is engaged with the second boss 52 for a fulcrum of rotation of the EPSS connector 12. Then, the lever 16 is pushed downward at the fulcrum of the boss 52 for a fulcrum of rotation as shown in FIG. 3B. Due to the foregoing, the service plug 14 is pushed and moved downward by a guiding action of the first boss 34 for a cam groove 46. As shown in FIG. 3C, at the rotation finishing position of the lever 16, the service plug 14 and the EPSS connector 12 are completely engaged with each other. Therefore, connection terminals of the EPSS connectors 12 and the service plug 14 are electrically connected with each other. However, at this stage, the interlock switch 28 is still at the off-position. Therefore, the electric power source circuit is not electrically continued.

In this connection, at the lever rotation starting position shown in FIG. 3A and the lever rotation finishing position shown in FIG. 3C, when the hemispherical protrusion 74 provided in the service plug housing 24 is engaged with the temporary fixing hole 76 formed in the lever 16, the lever 16 is temporarily fixed at each position.

FIGS. 11A and 11B are views showing a state right before the completion of rotation of the lever 16. Until this state, the lance 64 of the inter lock switch 28 is engaged with the lance engagement hole 66 of the guide member 56 of the EPSS connector 12. Therefore, it is impossible for the interlock handle 20 to be moved by sliding. In the state shown in FIGS. 11A and B, the interlock release member 68 provided in the lever 16 enters the lance engagement hole 66 of the interlock handle 20 and is going to push out the lance 64 of the interlock switch 28.

FIGS. 12A and 12B is a view showing a state after the completion of rotation of the lever 16. In this state, the rotation of the lever 16 is completed and the lock release member 68 pushes out the lance 64 from the lance engagement hole 66. Then the lock is released. Therefore, it is possible for the interlock handle 20 to be moved by sliding. Accordingly, the interlock handle 20 is pushed into the most inner portion shown in FIG. 12. Contrary to FIG. 11A, in which the switch terminal 60 is opened, in FIG. 12A, the switch terminal is electrically connected to the counterpart terminal. At this time, the electric power source circuit is electrically connected.

As shown in FIG. 12B, at the rotation finishing position of the lever 16, the lock pin 70 of the lever 16 enters the lock groove 72 of the interlock handle 20. Accordingly, the lever 16 is locked being incapable of rotating. Therefore, the service plug 14 is prevented from being unexpectedly detached.

According to the electric power source circuit breaker 10 of the above constitution, when the first boss 34 provided on the cover 30 made of metal attached to the service plug 14, is guided by the cam groove 46 formed in the engagement lever 16, the service plug 14 is engaged with the EPSS connector 12. Accordingly, even when a force is given to the first boss 34 at the time of engagement, the cover 30 is neither deformed nor damaged. There is no possibility that the terminals and fuses are exposed from the inside of the service plug housing 24.

Since the service plug 14 is pushed through the cover 30 made of metal, the service plug housing 24 is neither deformed nor damaged. There is no possibility that the terminals and fuses are exposed from the inside of the service plug housing 24.

At the point of time when the lock of the interlock handle 20 with respect to the EPSS connector 12 is released and the interlock handle 20 can be slid, the micro-switch 30 can be turned on and off for the first time. Accordingly, the operation of engagement and disengagement can be safely executed.

The electric power source circuit breaker 10 includes the interlock switch 28 for tuning on and off the micro-switch 30 having a water-proofing structure. Under the condition that the service plug 14 is not completely engaged with the EPSS connector 12, the interlock switch 28 is locked. Therefore, the interlock handle 20 can be not moved. When the service plug 14 is completely engaged with the EPSS connector 12, the lock of the interlock switch 28 is released and at the same time the slide lock is made by which the service plug 14 is prevented from being disconnected from the EPSS connector 12. Therefore, operation is safely executed.

When the lock pin 70 of the lever 16 is slid in the lock groove 72 of the interlock handle 20 to the most inner portion, the lock pin 70 is contacted with a side of the lock groove 72. Due to the foregoing, rattle of the engagement lever 16 generated by the vibration of a vehicle can be suppressed and the generation of noise can be suppressed.

It should be noted that the present invention is not limited to the above specific embodiment. All variations can be made without departing from the scope and spirit of the claim of the present invention. For example, in the above embodiment, the guide pin is provided in the service plug housing. However, the guide pin may be integrally provided on the cover made of metal. A protection mechanism such as a fuse may be provided in the attaching and detaching side housing 24.

What is claimed is:

1. A lever engagement type electric power source circuit breaker comprising:

a service plug including a service plug housing having a plurality of first connector terminals on a first side of the service plug housing;

a metal cover including a main body covering a second side of the service plug housing opposing to the first side and a boss integrally formed on the periphery of the main body;

an electric power source side connector including a plurality of second connector terminals to be connected to the first connector terminals and a shaft; and a lever including a cam groove to be engaged with the boss and pivotably supported by the shaft, wherein when the lever is operated to rotate, the service plug and the electric power source side connector are engaged with each other such that the first and the second connector terminals are electrically connected.

2. The circuit breaker according to claim 1, wherein the cam groove guides the boss under the rotation of the lever.

3. The circuit breaker according to claim 1, wherein the second side has an opening and the main body covers whole area of the opening.

4. The circuit breaker according to claim 1, wherein the service plug housing has a recess portion to which the boss is fitted.

5. The circuit breaker according to claim 1, wherein the service plug housing includes a guide pin and the lever includes a guide groove to be engaged with the guide pin.

6. The circuit breaker according to claim 1, wherein the cover includes a guide pin and the lever includes a guide groove to be engaged with the guide pin.

* * * * *